United States Patent [19]

Carson

[11] 4,397,212

[45] Aug. 9, 1983

[54] COMBINATION GUITAR VIBRATO AND PITCH CONTROL

[76] Inventor: David L. Carson, 2671 Evergreen St., San Diego, Calif. 92106

[21] Appl. No.: 340,773

[22] Filed: Jan. 19, 1981

[51] Int. Cl.[3] ..... G10D 3/12

[52] U.S. Cl. ..... 84/313; 84/297 R

[58] Field of Search ..... 84/312, 313, 327, 267, 84/297 R, 298–299

[56] References Cited

U.S. PATENT DOCUMENTS

| | | | |
|---|---|---|---|
| 2,241,911 | 5/1941 | Kauffman | 84/313 |
| 3,237,502 | 3/1966 | Moseley | 84/313 X |
| 3,686,993 | 8/1972 | Fender | 84/312 R |
| 4,044,645 | 8/1977 | Franzmann | 84/313 |
| 4,137,812 | 2/1979 | Franzmann | 84/313 |
| 4,317,403 | 3/1982 | Franzmann | 84/313 |

*Primary Examiner*—Lawrence R. Franklin

[57] ABSTRACT

Musician controlled relative motion between a generally standard stringed musical instrument (such as a Spanish guitar) and a false body hinged to the generally standard stringed instrument permits versatile control by the musician of the tension in one or more strings to produce both vibrato sounds and/or sustained pitch changes (both higher and lower pitches). The invention eliminates limitations of prior art which employed relative motion between neck and body of an otherwise generally standard stringed musical instrument.

13 Claims, 8 Drawing Figures

COMBINATION GUITAR VIBRATO AND PITCH CONTROL

BRIEF SUMMARY OF THE INVENTION

1. Field of the Invention

This invention relates to the field of stringed musical instruments (including but not limited to the Spanish guitar) in which the musician controls relative motion of certain parts of the stringed instruments to produce changes in string tension which produces vibrato sounds and/or sustained pitch changes.

2. Description of the Prior Art

The concept of using relative motion between the neck and body of a stringed instrument to produce vibrato sounds was, to the best knowledge of the applicant, introduced by the invention of U.S. Pat. No. 1,755,019 issued Apr. 15, 1930. The stringed musical instrument described in such patent performs the vibrato function using a mechanism consisting of the neck hinged relative to the body of the instrument with the axis of the hinge parallel to the plane containing the strings. This mechanism of such patent has four limitations which are eliminated by the present invention. These limitations are: (see FIG. 1 of U.S. Pat. No. 1,755,019 issued Apr. 15, 1930).

a. The motion of the neck relative to the body about an axis parallel to the plane of the strings is unnatural relative to the standard playing style of the musician and thus this motion limits the playing style and results in degraded quality of the music produced.

b. All strings of the stringed instrument must be actuated; that is, it is not possible to choose to have vibrato on only a subset of the strings.

c. No adjustment is provided to choose the amount of tension change and thus pitch change for a given amount of relative motion between the neck and body. Such an adjustment is needed to optimize the quality of the vibrato which may be created in conjunction with a normal music playing style.

d. The motion of the neck relative to the body about an axis parallel to the plane of the strings changes the spacing between the strings and the neck thus requiring an abnormally large initial spacing (larger than used in quality stringed instruments) in order to prevent touching of the strings and neck when the neck is oscillated relative to the body to produce the vibrato sound. Such touching of the strings and neck would result in a completely unacceptable buzzing noise. The greater spacing deteriorates the so called "action of the instrument", that is, the ease and speed with which the player can produce the different notes of the music.

e. The limitation explained in item d (directly above) makes it completely impractical to use enough relative motion to produce pitch changes of one-half tone or greater.

f. No special means are provided to make it easy and practical to sufficiently limit the motion of the body due to the torques developed when the musician attempts to move the neck to produce motion relative to the body and thus produce the corresponding vibrato sounds. Thus the quality of the vibrato sound producible is unnecessarily limited.

Discrete pitch change capability for a stringed musical instrument but without the vibrato capability were, to the best knowledge of the applicant, introduced by U.S. Pat. No. 3,512,443 issued May 19, 1970 and further considered in U.S. Pat. No. 3,686,993 issued Aug. 29, 1972. The present invention has the advantage of providing both a vibrato capability and a pitch changing capability in one mechanism.

NATURE AND SUBSTANCE OF THE INVENTION

The present invention eliminates the limitations described above. In the present invention, the generally conventional acoustic or electric stringed instrument 1 (see FIG. 1) is attached by a hinge 3 to a false body or supporting frame 2. The most advantageous orientation thus far discovered for the pivot or hinge axle 4 is that said pivot 4 be approximately perpendicular to a plane containing the plurality of strings 5. With said pivot orientation the required motion to actuate the pitch changes or vibrato sound is found to be natural and uninhibiting relative to the normal playing style of the player. One or more of the strings 5 can be actuated with the others not changed. Location of the hinge 3 can be chosen to optimize the quality of the vibrato which may be created in conjunction with a normal playing style. The distance between the strings 5 and the neck 7 is not changed by the relative motion between the generally conventional instrument 1 and the false body 2. Thus not only is an optimum spacing permitted as in a high-quality conventional stringed instrument but exaggerated relative motion is permitted thus making it practical to execute sustained pitch changes (higher or lower) of one-half tone and greater as well as execute the vibrato function.

DESCRIPTION OF PREFERRED EMBODIMENTS

Figure 1:
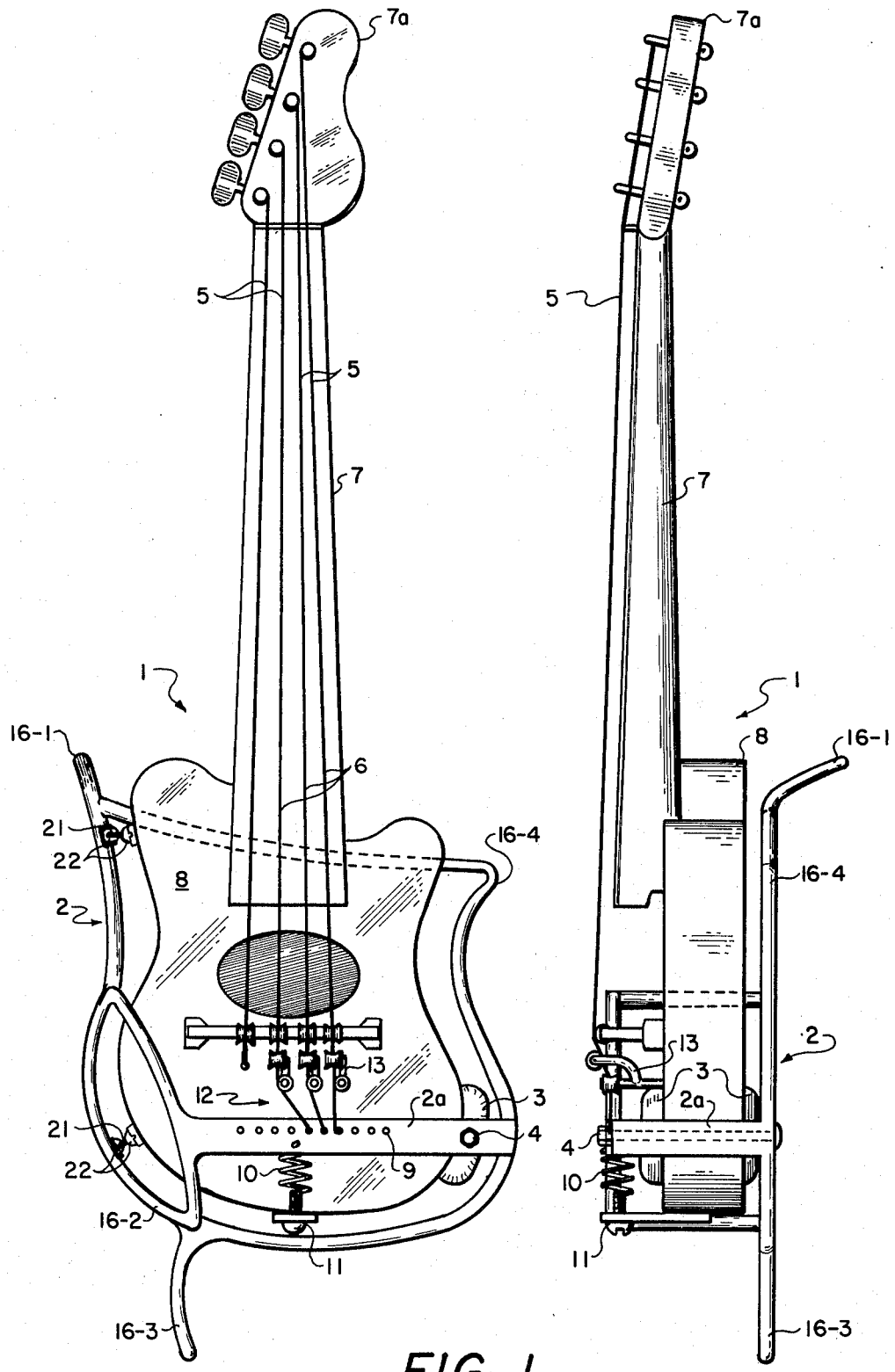
FIG. 1 is a top plan view and right side view of the new stringed instrument incorporating a false body as part of the mechanism.

Referring particularly to FIG. 1, the claimed new stringed musical instrument consists of a generally conventional acoustic or electric stringed instrument 1 (including but not limited to a Spanish guitar, banjo, mandolin or ukelele) connected by a hinge 3 to a false body or supporting frame 2 (shown as a cage-like construction) with the hinge axle or pivot pin 4 approximately perpendicular to the plane containing the plurality of strings 5 which strings 5 pass from the head 7*a* over the neck 7 and body 8. The pivot location is chosen to adjust as desired the relation of the rotational motion of said generally conventional stringed instrument 1 to the said false body 2 and thereby optimized the quality of the vibrato which may be produced with a normal playing style.

One or more of said plurality of strings 5 pass from the generally conventional stringed instrument 1 to the false body 2 and these false body attached strings 6 (6-1, 6-2, etc. indicate various such false body attached strings) are attached to the lever arm 2*a* of said false body 2 at attachment points 9 (9-1, 9-2, etc. indicate various such attachment points—the example in FIG. 1 assumes three strings are attached to the lever arm 2*a* of the false body). The strings which are not attached to said false body 2 are attached in the standard way to the bridge 19 of the generally conventional stringed instrument 1.

Adjustable spring 10 is connected to the generally standard stringed musical instrument 1 and the false body 2 thru adjustment screw mechanism 11. Said adjustable spring 10 biases the generally conventional stringed instrument 1 to a predetermined position relative to the false body 2. Said bias counterbalances both the effects of gravity and the forces produced by the false body attached strings 6.

When more than one of the plurality of strings 5 attaches to the false body 2, a means is needed to maintain a chosen relative pitch between the false body attached strings 6 during pitch changes induced by relative rotational motion between the generally conventional stringed instrument 1 and the false body 2. In other words, it is desired, during the pivotal movement between the instrument and its supporting frame by the musician, to maintain approximately the same ratios of tensions between the strings 6 as existed when the instrument was initially tuned. One such means is shown in FIG. 1 where the sizes of the adjustment angles 12 (12-1, 12-2, 12-3, etc. indicate various such adjustment angles) are chosen so as to maintain the desired relative pitch among strings 6 as the pitch is changed. The size of any given adjustment angle 12 is adjusted by selecting a suitably located attachment point 9 (such as 9-2) each of which points 9 is in this embodiment a hole bored in the false body 2. Pairs of adjustable wheeled guides 13 (such as 13-1, 13-2) maintain the desired location of the false body attached strings 6 relative to the bridge 19 located on the generally conventional stringed instrument 1. Said wheels of the adjustable wheeled guides 13 permit motion of said body attached strings 6 relative to the adjustable wheeled guides 13 without excessive friction.

Figure 3:
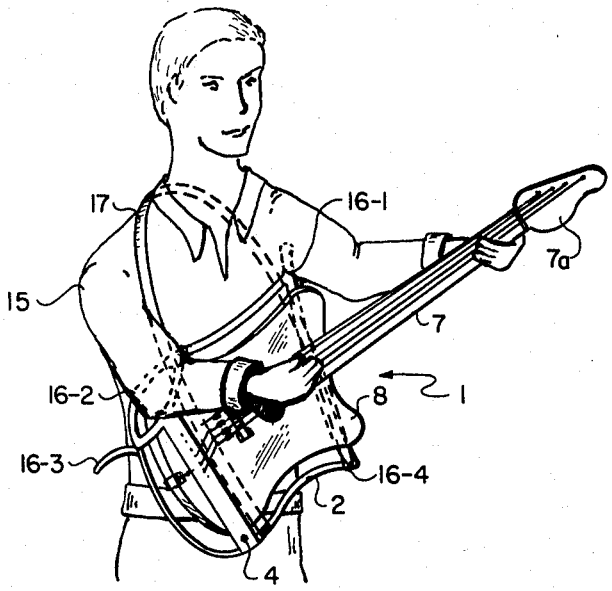
FIG. 3 is a player-standing orientation showing how torques are balanced from the standing position.
Figure 2:
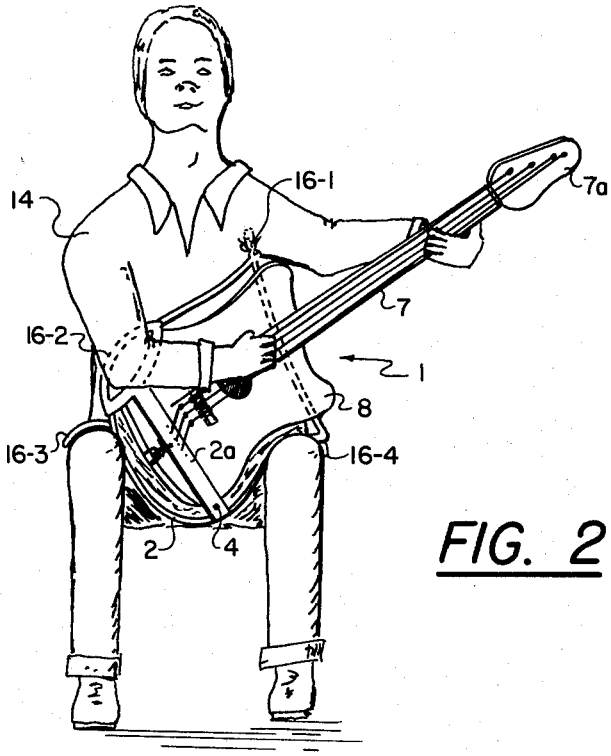
FIG. 2 is a player-sitting orientation showing how torques are balanced from the sitting position.

A torque balancing means is provided so that the player can limit the motion of the false body 2 due to torques produced when the player moves the generally conventional stringed instrument 1 as required to produce the vibrato sounds and/or sustained pitch changes. Said torque balancing means accommodates the two standard orientations of the player, the player-sitting orientation 14 shown in FIG. 2 and the player-standing orientation 15 shown in FIG. 3. Referring to FIG. 2 the moment of inertia and the contours of the false body 2 and corresponding player contact points 16, specifically points 16-1, 16-2, 16-3 and 16-4, provide said torque balancing means for the player-sitting orientation 14. Referring to FIG. 3 the said moment of inertia and the contours of the false body 2 (same as in FIG. 2) and corresponding contact with the player at player contact points labeled 16-1 and 16-2 plus shoulder strap 17 connected to the false body 2 provide said torque balancing means for the player-standing orientation 15.

Figure 4:
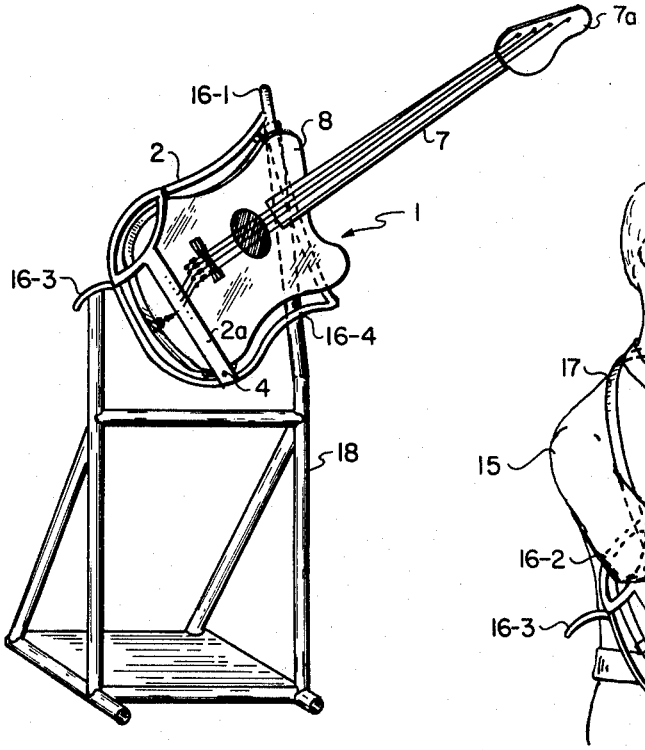
FIG. 4 is an isometric view of a floor-mounted stand as an alternate method of balancing torques from the standing position.

An alternate for long periods of standing by the player is shown in FIG. 4, where the false body 2 is attached to a floor-mounted stand 18 at player contact points 16-1, 16-3 and 16-4, provides a highly effective torque balancing means.

Figure 5:
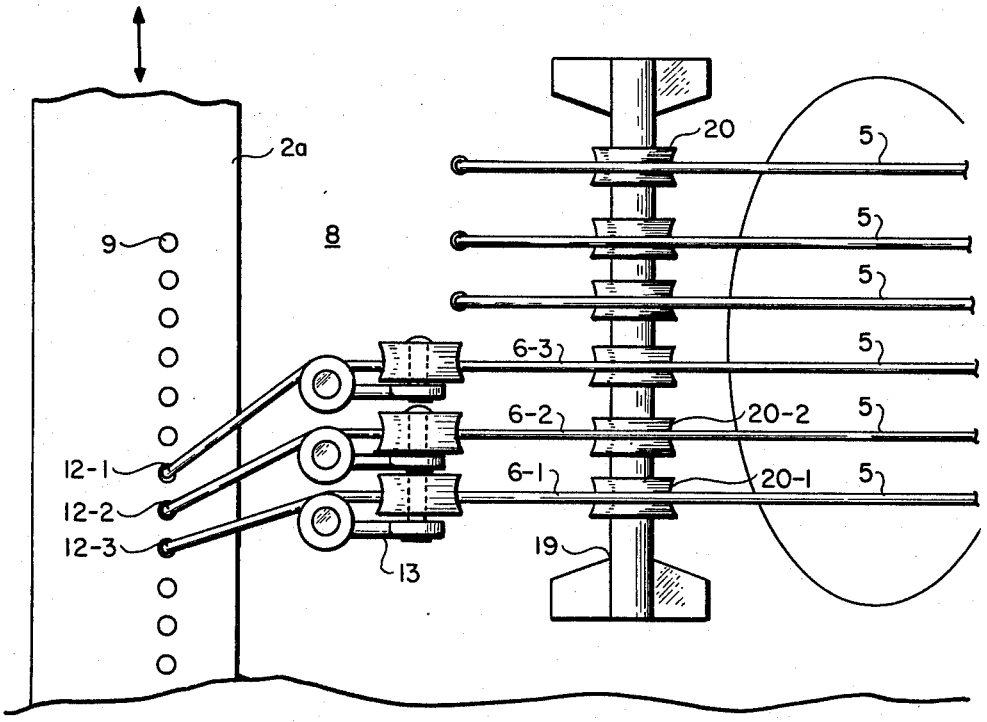
FIG. 5 is an enlarged top and side view of the wheeled bridge and wheeled pin components.
Figure 5:
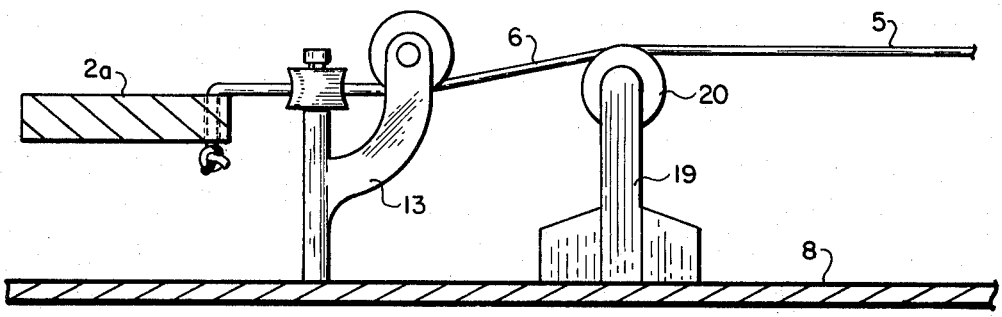

Due to the relative motion between the bridge 19 (see FIG. 1) and the false body attached strings 6, a means is required to minimize friction at points of contact of said strings and bridge 19. One such means is shown in FIG. 5 where bridge wheels 20 (20-1, 20-2, etc.) are shown as part of the otherwise conventional said bridge 19. Said bridge wheels 20 rotate in response to string motion.

Figure 6:
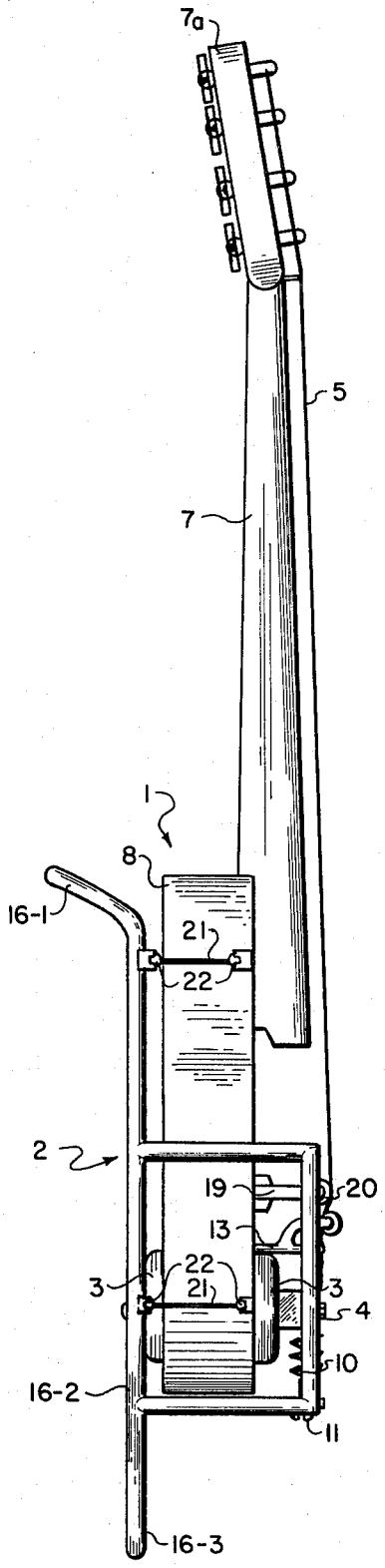
FIG. 6 is a left side view of the new stringed instrument emphasizing the stress rods and ball points.

Stress rods 21, shown most prominently in FIG. 6, with ball joints 22, assist the hinge 3 (see FIG. 1) in providing guide means minimizing undesired relative motions between the generally conventional stringed instrument 1 and the false body 2 but said stress rods 21 and said ball joints 22 do not inhibit the desired rotational relative motion between the generally conventional stringed instrument 1 and the false body 2.

EMBODIMENT OF FIG. 7

Figure 7:
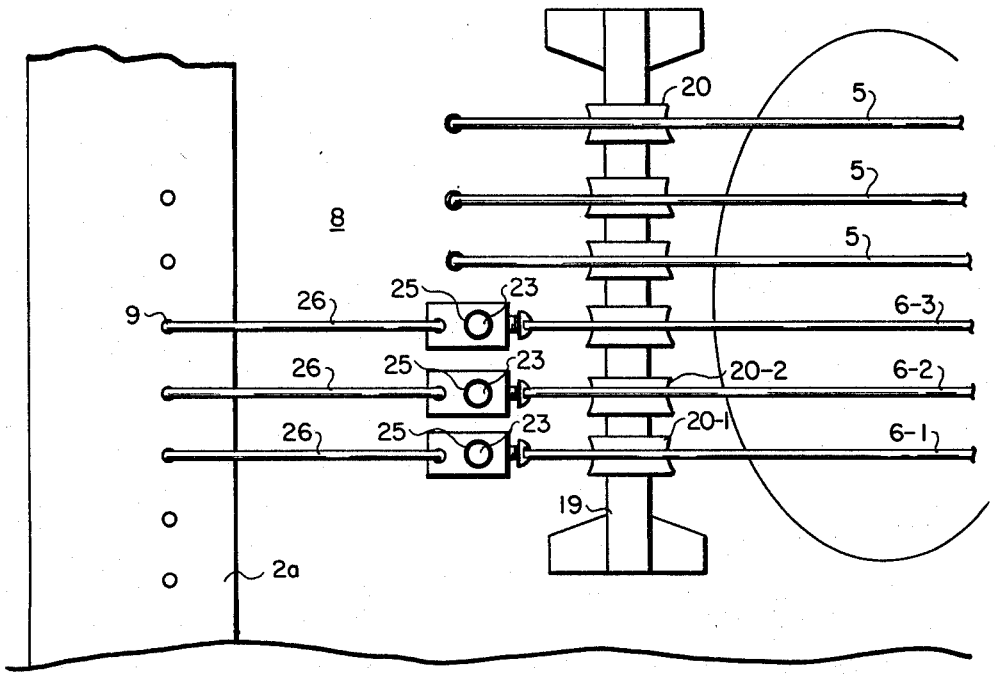
FIG. 7 is a side and top view of an alternate means of maintaining selected relative pitch relations in two or more strings.
Figure 7:
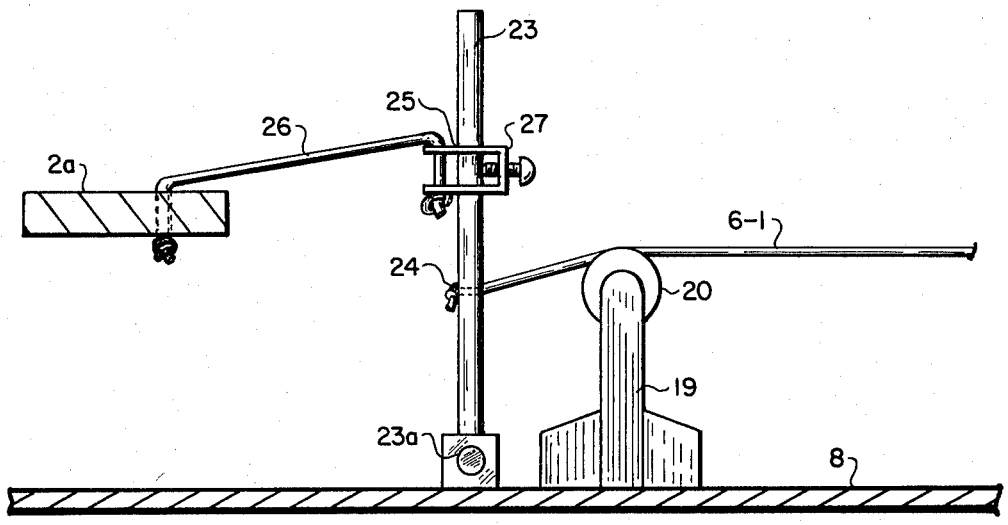

In the embodiment of FIG. 7 parts which correspond to those of the previous embodiment have been given the same reference numerals. The operation and construction of the embodiment of FIG. 7 are identical, except as specifically stated, to the operation and construction of the embodiment of FIGS. 1–6.

The embodiment of FIG. 7 uses an alternate means for maintaining a chosen relative pitch among the false body attached strings 6 as the pitch is changed. For each false body attached strings 6 there is a hinged lever arm 23 hinged to body 8 at 23*a*. The said string attaches to said lever arm 23 at the alternate attachment point 24 of the corresponding hinged lever arm 23. The hinged lever arm 23 is attached at an adjustment attachment point 25 to an auxiliary string 26 which in turn attaches to the selected attachment points 9 of false body 2. The location of the adjustable attachment point 25 is adjusted using an adjustable screw clamp 27.

The embodiment of FIG. 7 differs from the embodiments of FIGS. 1 and 5 in the means used to maintain a chosen relative pitch (that is, relative tension) among strings 6 during pitch changes induced by relative motion between instrument 1 and supporting frame 2. Instead of using adjustment angles 12 as in FIG. 1, adjustment points 25 in FIG. 7 are used to make adjustments to maintain a chosen relative pitch during pitch induced by the relative motion.

EMBODIMENT OF FIG. 8

Figure 8:
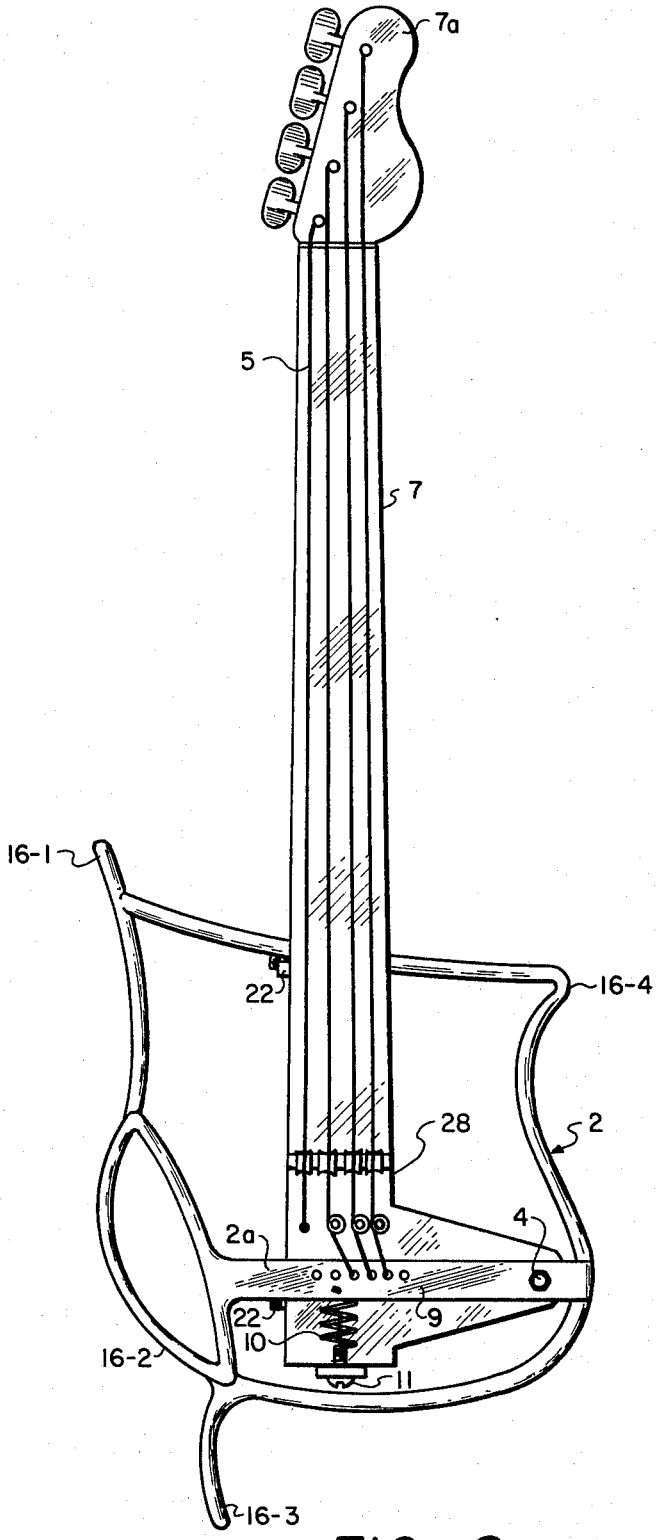
FIG. 8 is a top plan view showing the generally conventional stringed instrument component of FIG. 1 replaced by a simplified augmented neck which lends itself to a more economical instrument in the case of electric stringed instrument.

In the embodiment of FIG. 8 parts which correspond to those of the two previous embodiments have been given the same reference numerals. The operation and construction of the embodiment of FIG. 8 are identical, except as specifically stated, to the operation and construction of the embodiment of FIGS. 1–6 and the embodiment of FIG. 7.

The embodiment of FIG. 8 has replaced the body 8 of instrument 1 (see FIG. 1) with an L-shaped body 28. The embodiment of FIG. 8 is only used as an electric stringed instrument since no acoustic body is provided, as in FIG. 1. The embodiment of FIG. 8 lends itself to producing a commercially more economical, practical mass-producible musical instrument.

The foregoing detailed description is to be clearly understood as given by way of illustration and example only, the spirit and scope of this invention being limited solely by the appended claims.

I claim:

1. In a stringed instrument having a head, a neck, a body rigidly connected to the neck on which is mounted a bridge, and a plurality of strings each connected at one end to said head and extending along said neck over said bridge, the improvement comprising: an instrument supporting, rigid frame positioned exterior of said instrument and mounted thereto by a pivot substantially perpendicular to a plane generally containing said strings, at least some selected strings being connected at their other ends to a part of the frame functioning as a lever arm, another part of the frame functioning as a torque balancing means for torques due to the movement of the instrument with respect to the frame in both directions in said plane about said pivot whereby the natural swinging movement of the instrument, by the musician during playing, about said pivot relative to the frame will vary the length, and therefore the tension on the selected strings to produce sustained pitch changes and/or desired vibrato sounds.

2. The combination of claim 1 wherein said frame has a configuration generally conforming to the body shape of a conventional stringed instrument.

3. The combination of claim 2 wherein said frame is provided with torque balancing means for the musician in both a sitting and standing position.

4. The combination of claim 1 wherein biasing means are provided between the instrument and the frame to establish a predetermined relative neutral position therebetween.

5. The combination of claim 1 wherein guide means are provided between the body and the frame to assist the pivot in maintaining the rectilinear movement therebetween in said plane.

6. The combination of claim 1 wherein said lever arm has a plurality of individual string attaching means greater in number than the number of selected strings to provide different tension adjusting positions which are adjusted to maintain a chosen relative pitch among said selected strings during a sustained pitch changes and/or vibrato actuations.

7. The combination of claim 6 wherein some of the attaching means are laterally offset from their respective strings.

8. A supporting structure for a stringed instrument for producing a vibrato and/or sustained pitch sounds comprising:

a rigid frame lying exterior of said instrument;

a pivot for rotatably connecting the instrument to the frame, said pivot lying in a plane substantially perpendicular to a plane generally containing the strings of said instrument;

said frame having a torque balancing means to limit the movement of the frame when the musician moves the instrument to produce the vibrato and/or sustained pitch changes;

means on said frame for anchoring the ends of selected strings;

whereby a relative swinging motion of the instrument by the musician with respect to the frame will change the tension on said selected strings to produce the desired sounds.

9. The supporting structure of claim 8 wherein said frame is provided with a plurality of spaced guide means for assisting the pivot in maintaining a rectilinear movement of the instrument in said plane.

10. The supporting structure of claim 8 wherein said frame has a configuration approximating the configuration of a conventional stringed instrument body.

11. The supporting structure of claim 8 on which a vertically adjustable arm is mounted for each of the selected strings connected between a bridge and the frame to maintain a chosen relative pitch among said selected strings during sustained pitch changes and/or vibrato actuations.

12. The supporting structure of claim 8 wherein biasing means are provided between the instrument and the frame to establish a predetermined relative neutral position therebetween.

13. The supporting structure of claim 8 wherein said anchoring means in said frame is a lever arm extending substantially normal to said strings, said lever arm having a plurality of individual string attaching means greater in number than the number of selected strings to provide different tension adjusting positions which are adjusted to maintain a chosen relative pitch among the selected strings during sustained pitch changes and/or vibrato sounds.

* * * * *